United States Patent [19]

Latimer

[11] 4,413,925

[45] Nov. 8, 1983

[54] INDEPENDENTLY BALANCED SUPPORT PLATES

[75] Inventor: John P. Latimer, Newport News, Va.

[73] Assignee: Deepsea Ventures, Inc., Gloucester Point, Va.

[21] Appl. No.: 108,121

[22] Filed: Dec. 28, 1979

[51] Int. Cl.[3] ..... B63B 35/44; E02D 21/00

[52] U.S. Cl. ..... 405/195; 37/72; 114/264

[58] Field of Search ..... 405/195, 196, 202; 37/72; 138/107; 166/359; 175/85; 248/58, 182, 659–664, 183, 184, 185; 114/264

[56] References Cited

U.S. PATENT DOCUMENTS 3,776,320 12/1973 Brown ..... 175/85 X 4,215,950 8/1980 Stevenson ..... 405/195

4,224,723 9/1980 Clebant ..... 405/202 X 4,234,269 11/1980 Person et al. ..... 405/195

*Primary Examiner*—David H. Corbin

*Attorney, Agent, or Firm*—Barry G. Magidoff

[57] ABSTRACT

This invention provides apparatus for supporting extremely heavy weights, such as a lengthy horizontal pipe string for ocean floor mining or dredging, from a downwardly facing horizontal ledge surface. The apparatus comprises a pair of support plates arranged evenly about the surface to be supported. Each plate is reciprocally movable toward and away from the object to be supported and is pivotably supported about two transverse horizontal axes. One axis preferably extends radially relative to the centerline of the surface to be supported.

11 Claims, 11 Drawing Figures

120
124
143a
132
140
135
122
148
146
145
143b
149
123
141
125
130
128
127
131
121

INDEPENDENTLY BALANCED SUPPORT PLATES

This invention is directed to means for supporting relatively heavy weights from a pair of transversely movable, horizontal support surfaces, which are narrow relative to the supported surface. The support members are structurally independent in at least one direction and operatively connected in a second direction, such that the relatively heavy load is maintained in a balanced position. This invention is especially adapted for use in the support of the extremely lengthy and heavy dredge pipeline used in the recovery of ore material from the abyssal ocean floor.

With the recognition that terrestrial sources for raw materials, especially ores, are being swiftly depleted, effort has been made to obtain these valuable industrial raw materials from other sources, one being especially the abyssal depths of the oceans. Such raw materials, especially metal ores, are often found at depths of between 10,000 and 18,000 feet below the surface, requiring extremely deep water dredging means. The most valuable ores found to date are known as ocean floor nodule ores, or manganese nodules. These nodules are often found as relatively small particulate forms, including fist-sized rocks or smaller pebbles, or even as grains of sand. Sometimes solid shelves of these materials are found which would have to be broken up in order to be obtained.

A great deal of engineering effort has been undertaken to date to develop mechanical means to mine such ores and to bring the ores to the surface for further processing. One system now under development for carrying ocean floor ores to the surface of the ocean comprises a dredging vehicle, operating at or near the ocean floor, and a water-lift system, wherein the ore particles are carried upwardly to the surface in a stream of water defined by a length of pipe extending from the undersea dredge vehicle to a surface vessel. This pipe system is generally part of a so-called airlift means, wherein the water within the pipe is caused to flow upwardly by means of injections of air into the pipe at points below the surface.

A serious practical problem encountered in the design and operation of such a mining system arises as a result of the great weight of the dredge pipe string, which is of high strength, relatively thick steel piping, extending for distances of, generally, from about two to three-and-one-half miles. The pipe is generally formed from a series of relatively short lengths of pipe, several hundred individual lengths, or sections, making up the total dredge pipe string. Necessary support for the dredge pipe string must be accomplished not only during the time when the entire pipe string is in place and dredging occurs by moving a dredge vehicle along the ocean surface, but also during so-called "tripping", when the pipe string is being let down to the ocean floor, i.e., by adding individual lengths one at a time and gradually permitting the pipe string to thus descend towards the ocean floor, or when the pipe is being brought in, i.e., individual lengths of pipe are serially removed from the pipe string and stored, while the dredge pipe length is gradually being shortened and the dredge vehicle brought to the surface of the ocean.

One method for supporting the pipe string during these various periods, includes a series of support plates, extending circumferentially around the uppermost end of the pipe string, and having resting thereon a radially outwardly extending horizontal ledge, formed by an enlarged end hub on the uppermost section of pipe. In actual practice, such an enlarged hub or ledge is formed at the ends of each of the pipe lengths, and as the pipe is tripped upwardly or downwardly, the support plates contact the end ledges on successive lengths of pipe, thereby supporting the entire length of pipe, extending from the ship downwardly towards the ocean floor. The great mass of this pipe results in weights of several millions of pounds being supported by the support plates, when the pipe is completely extended. The great weight thus being supported, makes it absolutely essential that the pipe be evenly supported around its circumference, such that there is no uneven stress exerted between the support plates and the pipe ledge, which would create a torsion moment capable of cracking even the strongest pipe wall at the joint. It has been necessary to accurately machine all of the support plates, and, perhaps even more arduous, each of the pipe ledges, on each of the several hundred lengths of pipe, must be carefully machined to exact tolerances. Further, each of the support plates must be carefully placed upon the primary support platform, so as to be of equal height to that of all the other support plates. These present serious practical problems, which can greatly increase the cost, and increase the problems encountered in actual practice, unless they are resolved.

The present invention provides independently pivotally suspended support plates, e.g., for a dredge pipeline extending from a surface vessel to the ocean floor. In accordance with the present invention, there is provided means for supporting extremely heavy weights from horizontal, downwardly facing ledge surface, the means comprising a pair of support plates, preferably wherein each segment is in contact with less than one-half of the ledge surface. The pair of support plates extend outwardly from the ledge surface on either side of the centerline of the object being supported, so as to maintain the object in balance. Each of the support plates is preferably reciprocally movable between a position beneath the horizontal ledge and a position beyond the horizontal ledge, the movement being preferably radially inwardly and outwardly, reciprocally relative to the centerline of the heavy weight being supported. Each support plate is also pivotably supported about two axes, at least one axis of each plate being independent of the other plate. At least one of such axes is a radially extending axis; the second axis extends transversely, preferably perpendicularly, to the first axis, but parallel to the plane formed by the support plates.

The segmented support plates preferably support a downwardly facing, horizontal ledge extending outwardly from the circumference of a main dredge pipe. Such downwardly facing support ledges are commonly formed on each pipe length, which are interconnected to form a downwardly extending dredge pipe line. In one preferred embodiment, the balanced support members are formed on the top surface of a vertically movable platform, supported in turn from a gimbaled platform; a complementary pair of balanced support plates is supported from the lower surface of the gimbaled platform. The dredge pipeline can thus be passed between the two support plate pairs, the movable platform thus moving the dredge pipeline in an upwardly or downwardly direction, and the pair of support plates on the gimbaled platform supporting the pipeline during the return movement of the movable platform.

The invention defined herein is exemplified by the embodiments described hereinbelow and depicted in the accompanying drawings. The preferred embodiments are presented herein to provide a more clear understanding of the invention and its advantages, and not to limit the scope of the invention.

Figure 1:
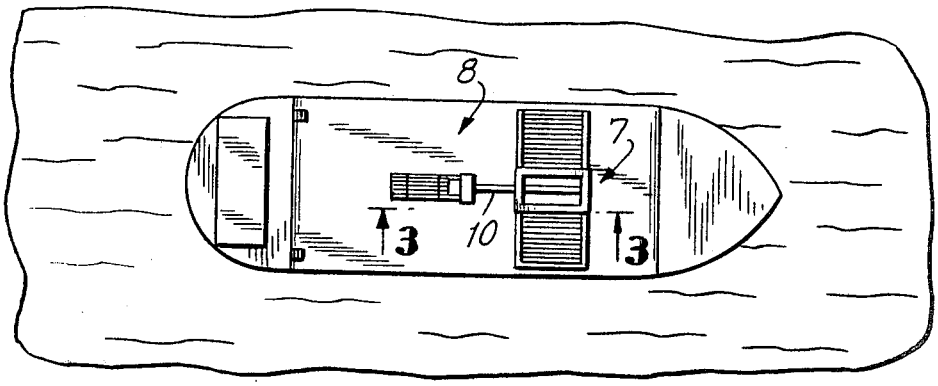
FIG. 1 is a diagrammatic plan-view of an ocean-going vessel fitted for ocean floor mining operations.
Figure 2:
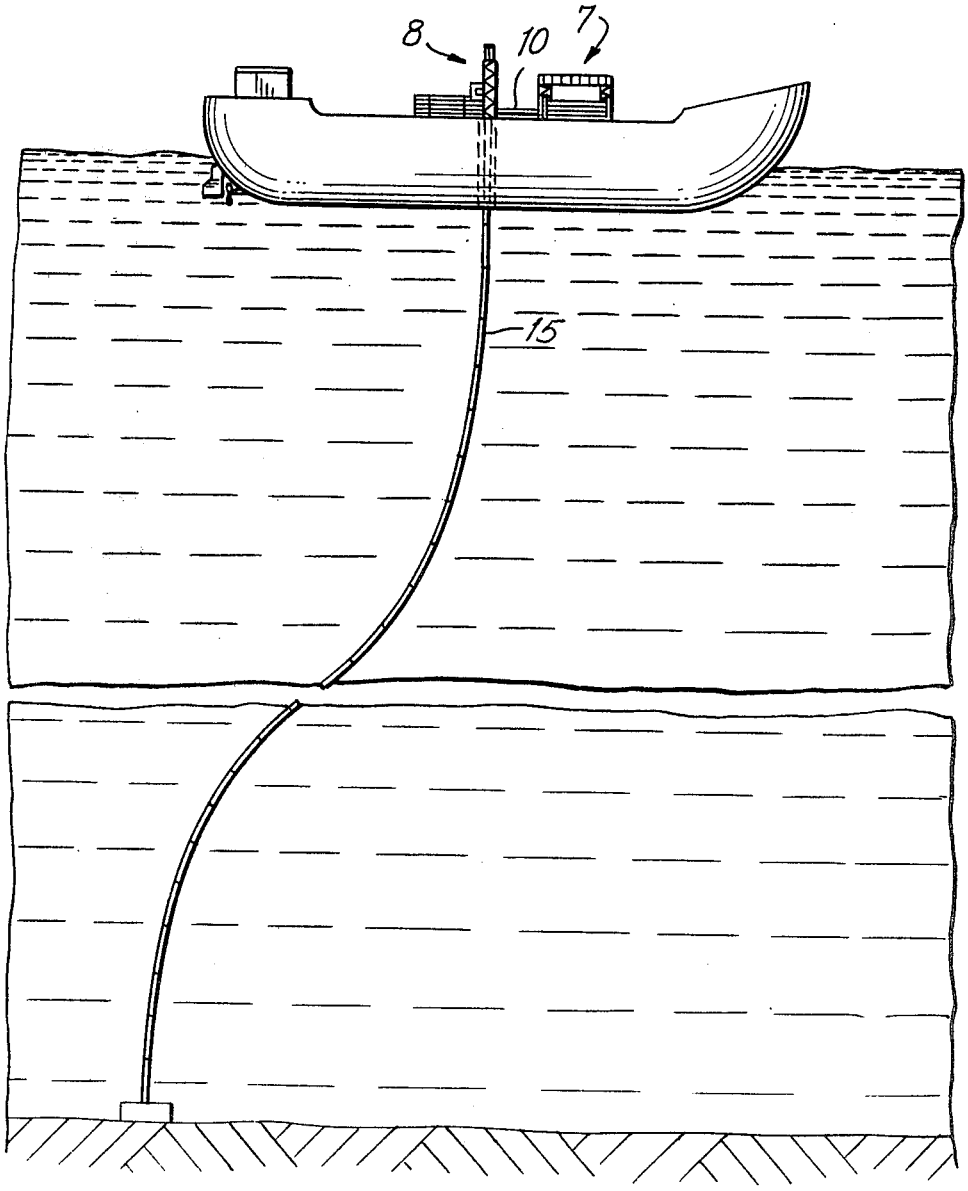
FIG. 2 is a side elevation view of the vessel of FIG. 1, including a downwardly extending pipe string extending towards the ocean floor.
Figure 3:
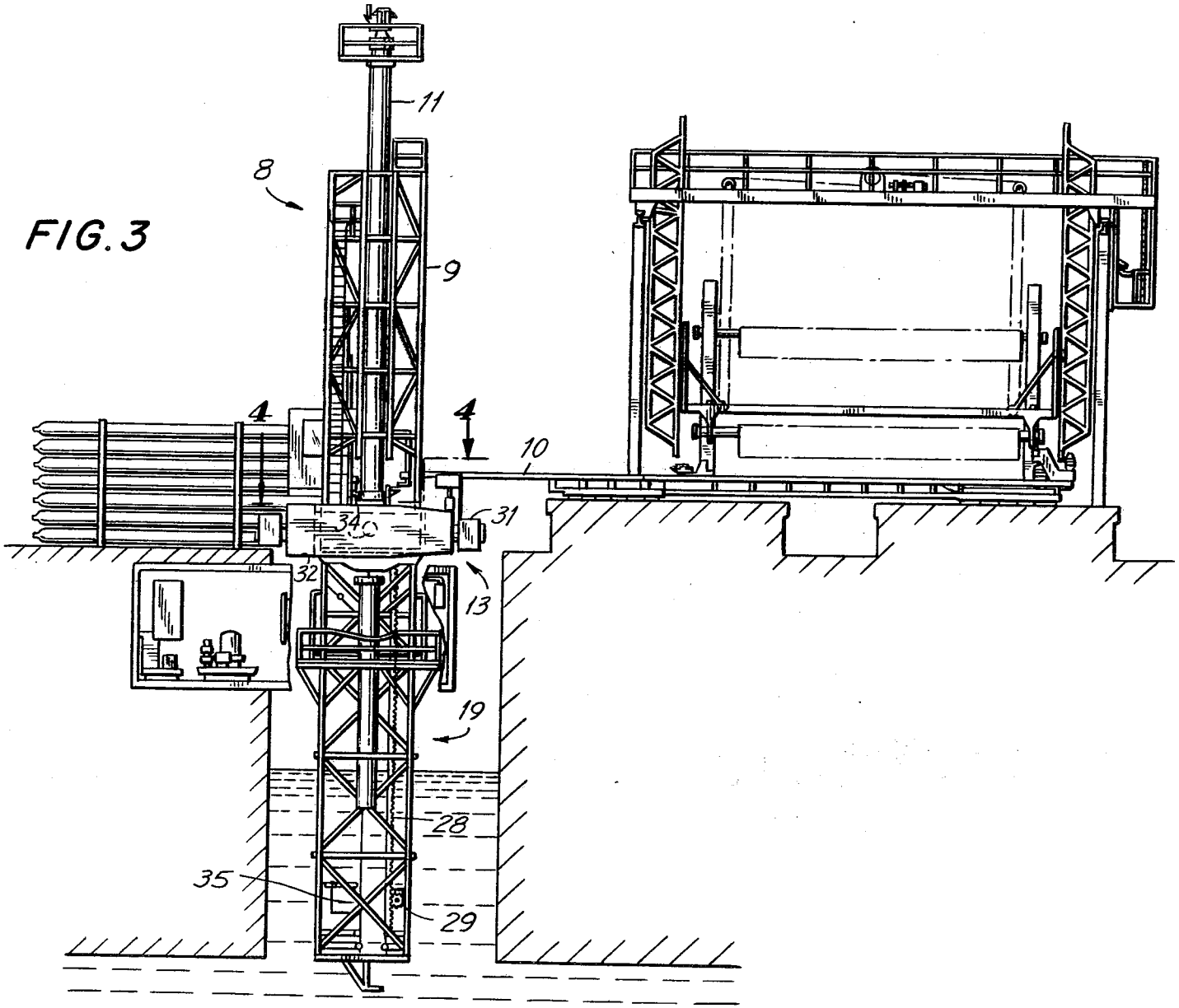
FIG. 3 is a side elevation view of the portion of the vessel of FIGS. 1 and 2 comprising the primary ocean floor dredge line-supporting apparatus.
Figure 4:
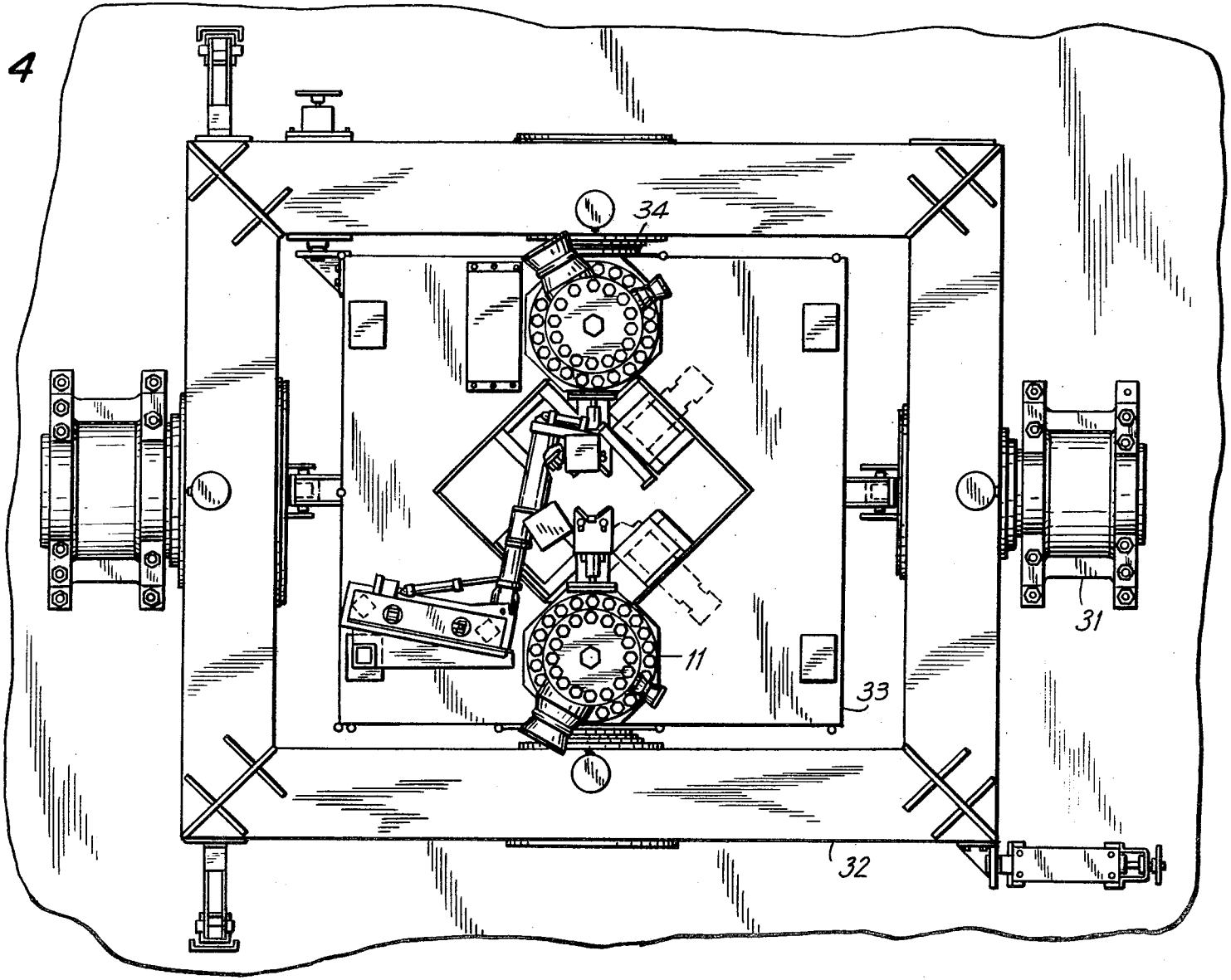
FIG. 4 is a top plan view of a gimbaled platform on the ship.

FIGS. 1 and 2 show a plan and side elevational view of an ocean-going vessel structured specifically for use in ocean floor mining operations. Unusual features on this vessel, distinguishing it clearly from ordinary ocean-going vessels, are shown in the drawings. These special features include a large central opening, or well, extending from the deck of the vessel through the bottom of the vessel. The well is fully enclosed, having interior wall surfaces maintaining the integrity of the vessel's hull covering. Extending above the well opening, is a superstructure which can be generally called a derrick, its location being generally indicated by the numeral 8. The derrick 8 and associated pipe handling system are mounted upon a platform which is pivotable relative to the vessel about two horizontal, transverse (substantially perpendicular in this case) axes. The derrick 8, including its associated systems, rests upon an inner gimbaled platform 33, which is pivotally supported by a gimbal axis 34 to an outer gimbal ring 32 which is in turn pivotally supported on an outer gimbal axis 31, connected to the surface vessel and being in the same plane as, but perpendicular to, the inner gimbal axis 34. The derrick 8 is thus pivotally connected to the surface vessel about two perpendicular axes, able to compensate for the pitch and roll of the vessel under even the extreme conditions met with on the ocean surface. Thus, the derrick 8 is permitted to remain substantially continuously vertical, regardless of the pitching and rolling motion of the vessel. As can be generally seen from the drawings, the outer gimbal axis and the inner gimbal axis are preferably substantially located along the longitudinal centerline and the lateral centerline of the vessel, so as to minimize the effect of the rolling and pitching motion in causing relative movement between the gimbaled inner platform and the vessel. The vertical axis of the derrick, is thus located at the substantial centerpoint of the vessel, i.e., the intersection of the longitudinal and lateral axes. FIG. 2 shows the dredge pipe string extending downwardly from the vessel to the ocean floor, trailing behind the vessel as the vessel is continuously moving, pulling an ore gathering device at the end of the dredge pipeline resting on the ocean floor.

The derrick 8 comprises a pair of main hydraulic hoist cylinders 11, supported by the inner gimbaled platform 33, and extending upwardly therefrom. The axis of rotation of the platform 33 extends along the diameters of both of the hydraulic hoist cylinders 11, i.e., the cylinders 11 are centered on the axis.

The main hoist piston rods 12 extend downwardly from and are slidably connected inside of, the main hoist cylinders 11. Suspended from the main hoist piston rods 12, is a main hoist platform 35 which moves together with the piston rods 12, in a vertical direction towards and away from the gimbaled platform 33. The two hoist cylinders are hydraulically interconnected, in a manner known to the art, to maintain, as much as possible, the movable hoist platform 35 in an even position, i.e., the two hoist piston rods 12 move together in an upwardly and downwardly direction.

Supported downwardly from the inner gimbaled platform 33, is a lower derrick structure, generally designated by the numeral 19, which surrounds the space through which the movable platform 35 moves. Supported on the lower derrick structure 19 is at least one, and preferably a pair, of tracks having square-cut teeth formed along one surface thereof. The tracks extend preferably on either side of the movable hoist platform 35 along the derrick structure 19. Rotatably secured to opposite ends of the movable platform 35 and so placed as to be in contact with the square-cut teeth on the track 28, are pinion gears 29 having square-cut teeth complementing those formed on the track 28. The gears 29 and track 28 are in contact during the vertical movement of the hoist platform 35.

Secured through the upper surface of the movable hoist platform 35, extending transversely between the main support piston rods 12, are a pair of primary support beams 120, pivotally supported upon primary support pedestals 121, substantially centered on the platform 35 between the two main piston rods 12 and on either side of a central opening through the platform 35. Rigidly secured to the central portion of each primary support beam 120 are a pair of primary beam rings 130, and passing through the journals and locked thereto by lock plate 131, is a primary gimbal shaft 125. Each gimbal shaft 125 also passes through a pedestal journal 127, and through two washers 128 located intermediate the pedestal journal 127 and the primary support beam rings 130. A pair of traverse slots defined by surfaces 124 are formed along the main support beams 120, and extend longitudinally along either side of the support pedestal 121 and the shaft rings 130.

Slidably secured within each slot 124 and extending between the pair of main support beams 120, are a pair of traverse beams 122, 123, extending transversely to the support beams 120 and movable along the slots 124. Each traverse beam 122, 123, comprises a pair of shaft journals 140, 141, extending upwardly from the beam and having central openings therethrough, the two central openings in rings 140, 141, being in line and extending transverse to the length of each transverse beam 122, 123. A secondary gimbal shaft 135 extends through each pair of traverse journals 140, 141, and also through a central opening through pipe support plates 132, 133. The secondary gimbal shaft being pinned to the support plates 132, 133, by locking pins 136. A series of washers 141 is located between the traverse beam journals 140 and each of the adjoining portions of the support plates 132, 133.

A bearing support beam 149 extends transversely between the ends of the two primary support beams 120. Rotatably secured to each end of the bearing support beam 149 and journalled into into its own bearing, are a pair of traversing screws 143, extending adjacent to and along the primary support beams 120 and connected at their other ends to a pair of beveled gear boxes 148, The boxes 148 are also secured to the other end of each of the primary support beams 120. The traversing screws 143 are threaded, the threaded surface of screws 143 being such that the end adjacent the bearing support beam 149 is threaded in one direction (**143*b*) and the end secured to the belveled gear boxes 148 is threaded in the opposite direction (143*a*). Supported upon and threadedly secured, to the traversing screws 143, are the traversing beams 122, 123. Traversing beam 122 is threadedly secured to the second end 143*a* of each traversing screw 143 and traversing beam 123 is secured to the first end 143*b*** of each traversing screw.

The beveled gear boxes 148 are each in turn operatively connected to shafts 146, having various necessary bearings and flexible couplings, which are in turn connected onto a double-shafted hydraulic motor 145, connected to a source of hydraulic power not shown.

An equivalent pair of support plates can be supported from the bottom surface of the gimbaled platform 33.

OPERATION OF THE SYSTEM

Referring to FIGS. 1 to 4, an ocean-going vessel is shown moving at a relatively slow pace, with a dredging pipeline extending beneath and behind the vessel, as the vessel moves in a forward direction. The length of pipe 15, is supported by pipe string support members on the inner gimbaled platform 33, which is in turn supported by the hydraulic piston rods 12. When the pipe string 15 is supported from the gimbaled platform 33, the pipe string is vertically fixed relative to the ocean-going vessel. However, when the pipe string is supported by pipe support plates 132, 133, the pipe string is vertically movable relative to the ocean-going vessel. In this system, pipe 15 having the general configuration shown in Application Ser. No. 910,424, filed on May 30, 1978, now U.S. Pat. No. 4,200,999, including a main dredge line pipe and a secondary air line pipe, plus a pivotable splitter plate pivotally connected to the secondary air line pipe, forms at least a portion of the dredge pipeline 15. The dredge pipeline 15 is formed of individual segments of pipe, for example, approximately 30 feet long, connected together by joints, or hubs, at each end of the individual lengths, to form the dredge pipeline 15, which in usual ocean dredging operations has a total length of about 15,000 feet.

The two support members, specifically the support plates 132, 133, on the movable platform and the support members on the gimbaled platform 33, are used alternatively, especially during what is known as "tripping" of the pipe, i.e., the gradual letting down, or bringing up, of the individual pipe lengths, as the dredge pipe string is lowered from the surface vessel to the ocean floor. One system for transferring pipe from a storage location on the vessel to the pipe string, is shown in a commonly assigned Application entitled "PIPE TRANSFER SYSTEM MEANS" application Ser. No. 108,123, filed on Dec. 28, 1979, now U.S. Pat. No. 4,347,029. An individual pipe length is transferred by such means from the pipe storage area to the derrick 8, where it is held in a vertical position while the lower end of the pipe is secured to the upper end of the pipe string, which is in turn held by the pipe support members supported from the lower surface of the gimbaled platform 33. After the pipe is secured, the hydraulically lifted platform 35 is moved upwardly by the hydraulic piston rods 12 until it is located immediately below the gimbaled platform such that the pipe support plates 132, 133, can be moved under a second ledge on the pipe hub. When the support plates 132, 133 are in place supporting the pipe from the lower ledge of the pipe hub, the upper pipe supporting members are withdrawn and the pipe string can then be moved downwardly along the lower derrick 19, as the movable platform 35 moves downwardly, until the upper end of the new pipe length is in the proper relation to the upper support members, such that the pipe supporting members on the gimbaled platform 33 can be moved into position to support the pipe string beneath the upper ledge of this next pipe hub. See the explanation of this action in concurrently herewith, copending application Ser. No. 108,122, filed Dec. 28, 1979, entitled: "PIPE STRING LIFT SYSTEM".

Figure 5:
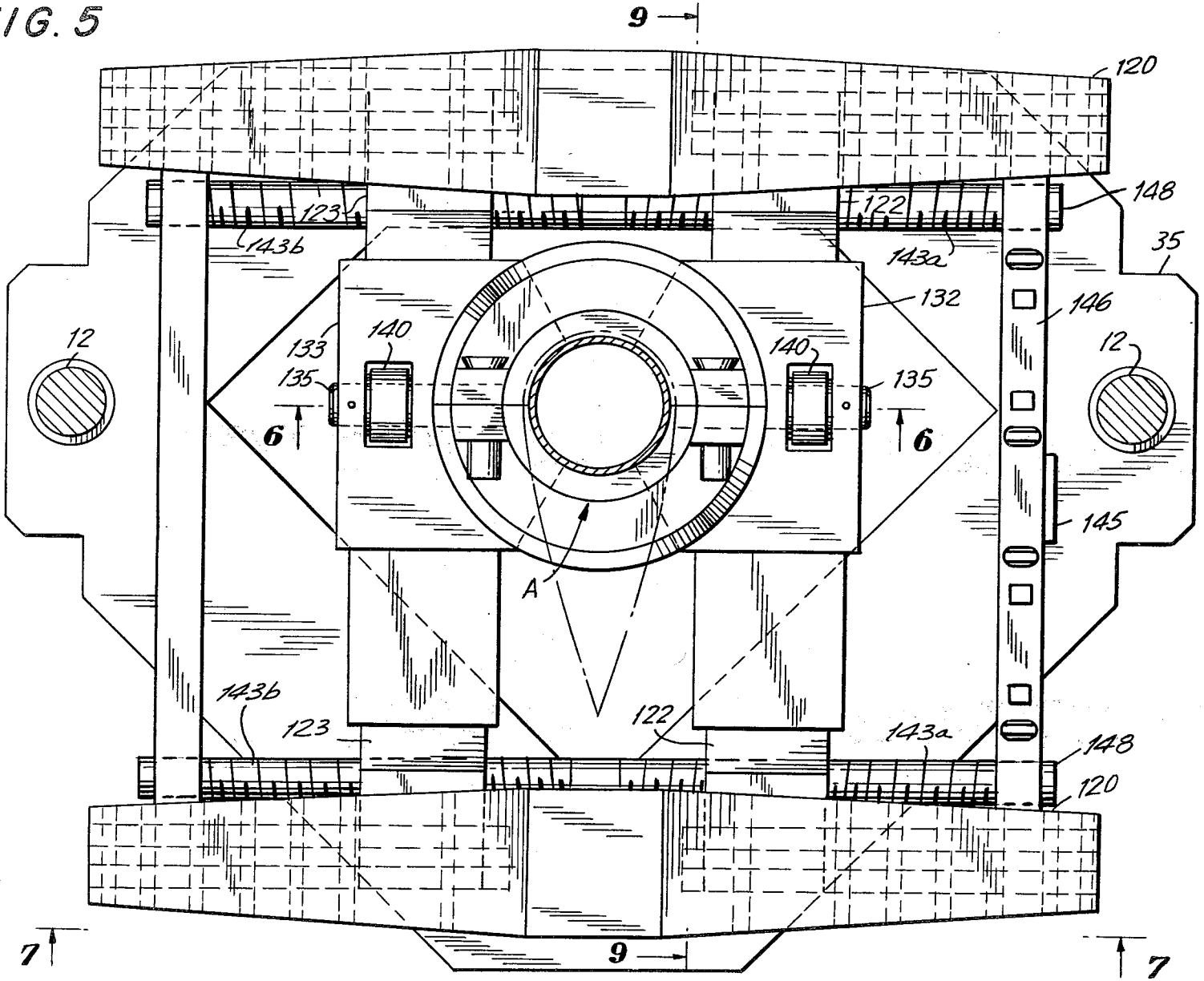
FIG. 5 is a top plan view of a vertically movable support platform.
Figure 6:
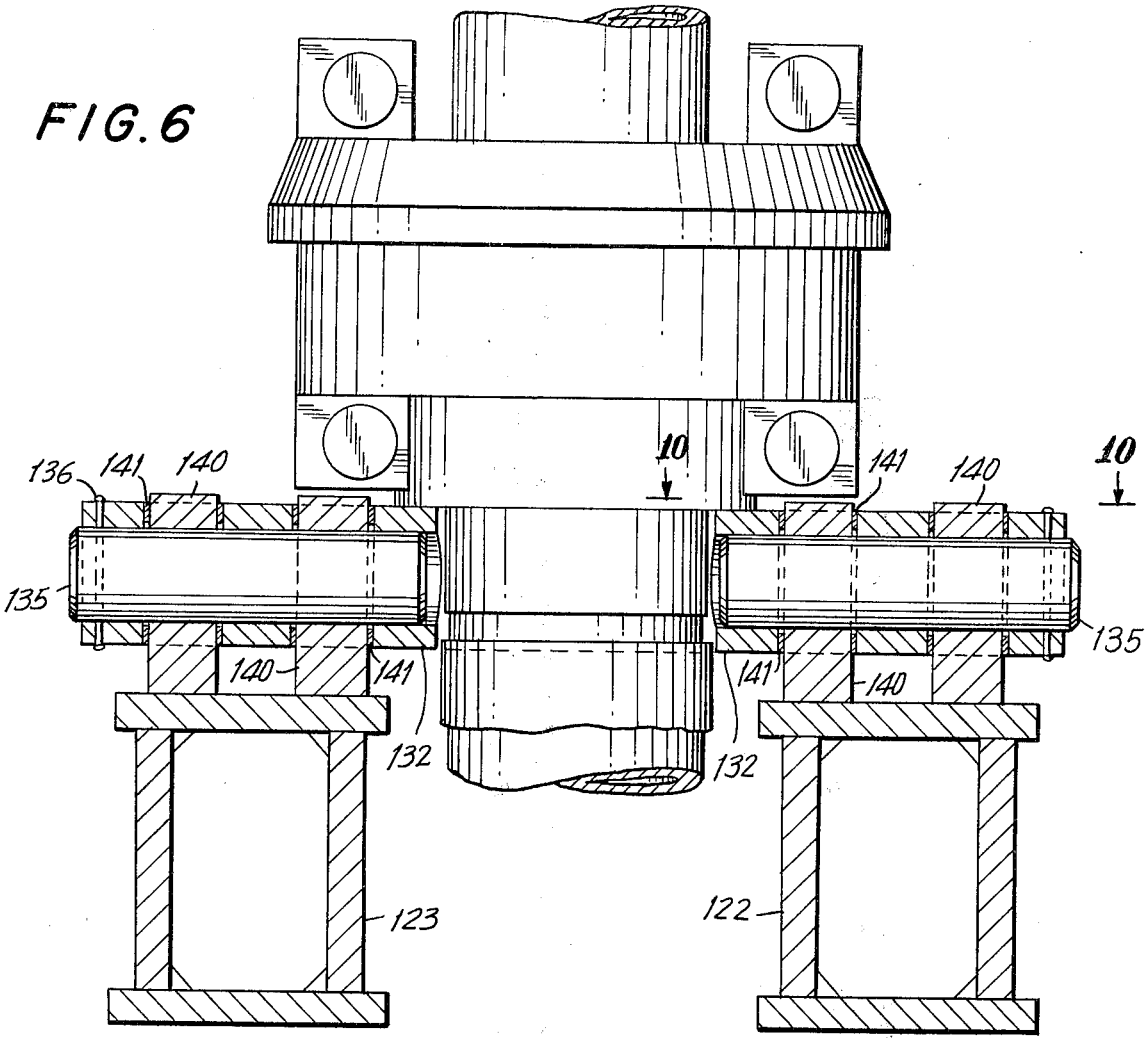
FIG. 6 is a cross-sectional view taken along lines 6—6 of FIG. 5.
Figure 7:
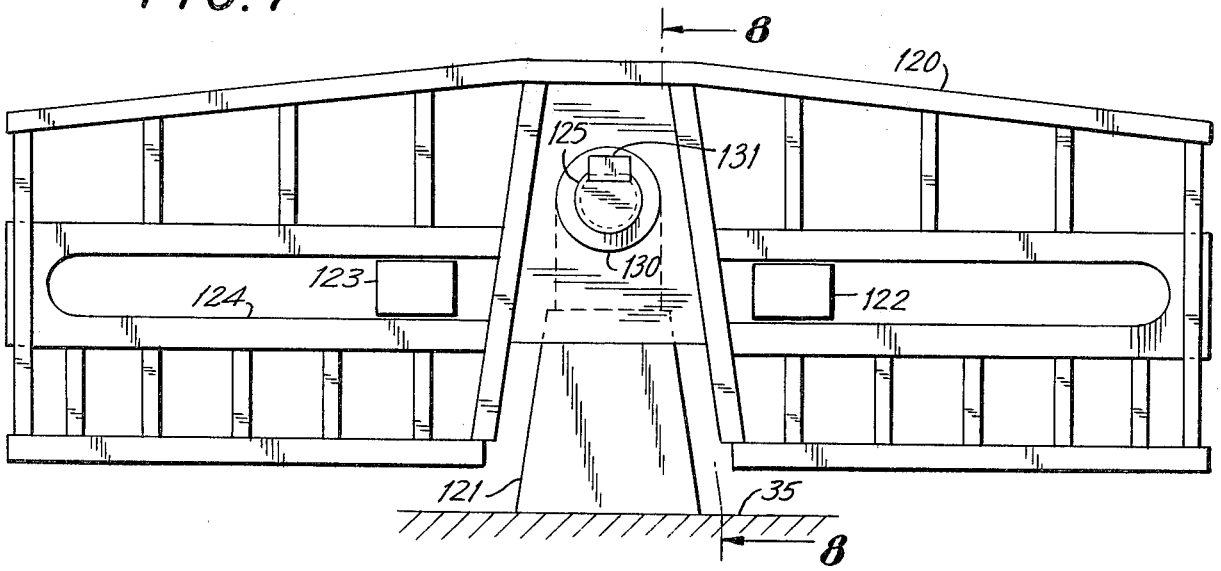
FIG. 7 is a cross-sectional view taken along lines 7—7 of FIG. 5.
Figures 8, 9, 10, 11:
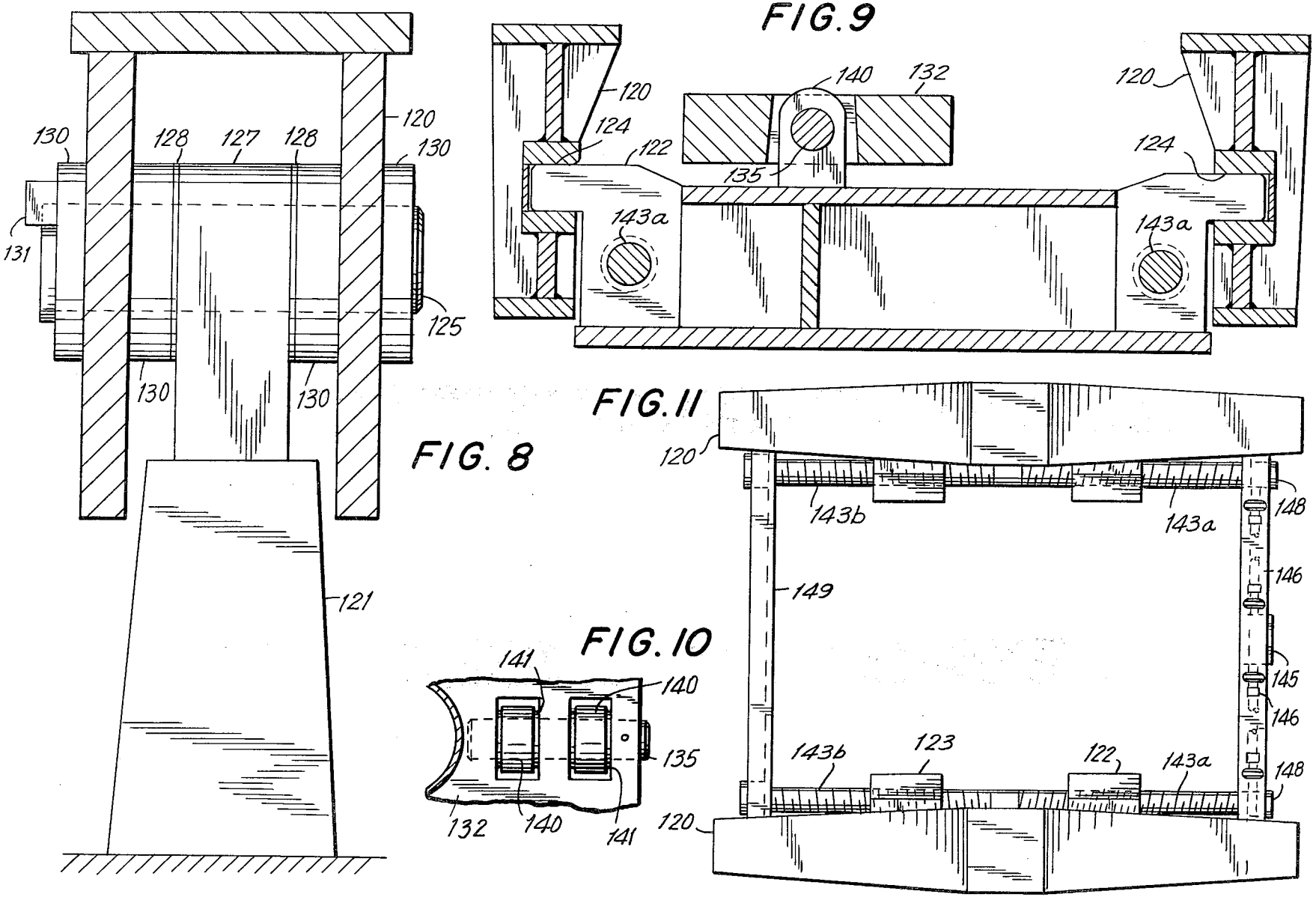
FIG. 8 is a cross-sectional view taken along lines 8—8 of FIG. 7.
FIG. 9 is a section view taken along lines 9—9 of FIG. 5.
FIG. 10 is a section view taken along lines 10—10 of FIG. 6.
FIG. 11 is a top plan view similar to that of FIG. 5.

The individual pipe support plates 132, 133, for example, on the movable platform, are moved radially inwardly and outwardly relative to the pipe hub by operation of the hydraulic motor 145. Referring to FIG. 5, the support plates 132, 133, are shown in a supporting position about the hub of a dredge pipe string (generally indicated by the numeral A). In the embodiment shown in FIG. 5. the pipestring includes fairing means, rotatably connected about the main length of each pipe section, intermediate the hub portions. Preferably, the radially inwardmost surfaces of the support plates 132, 133, are maintained slightly out of contact with the main surface of the pipe, beneath the supporting ledge surface. This permits the self-balancing action to take place, as explained below.

When the supporting plates on the upper platform are in position to support an upper pipe hub, the support plates 132, 133, are withdrawn by activating the hydraulic motor 145 which in turn causes rotation of the traverse screws 143, in such a direction as to cause each of the traverse beams 122, 123, to move radially outwardly, one away from the other. Movement of the traversing beams 132, 133, cause movement of the plates supported thereon. When it is desired to return the support plates 132, 133, to a supporting position, the hydraulic motor is reversed, power being transmitted by the drive shaft 146 through beveled gear boxes 148 to the traversing screws 143 causing the screws 143 to rotate in an opposite direction causing the traversing beams 122, 123 to move towards the center, i.e., towards each other. The traverse beams are supported within and move along the slot surfaces 124 in the primary support beams 120.

The primary support beams 120 are each supported only by the shaft 125, and thereby are pivotable about the pedestals 121, in response to any shifting or unbalancing of weight upon the support plates 132, 133. Similarly, each support plate is independently pivotably balanced upon shaft 135, and thus can pivot in a transverse direction in the event of any unbalanced force on each of the support plates 132, 133, created by any unevenness on the support ledge or unbalancing of the supported dredge pipeline. As explained above, although such even distribution can be obtained by a careful aligning and machining of the upper surfaces of the support plates 132, 133, and an equally careful machining of all of the pipe hub ledges along the entire pipe string, these are extremely arduous requirements, and would significantly increase the cost of production of such equipment. The present system eases the burden of machining each of the pipe hub ledge surfaces and of preliminarily aligning the two pipe support plates on the platform, by providing the self-balancing features herein, whereby any inequality or unevenness, within the limits of the operation of the system, can be counterbalanced or equalized by a repositioning of the support members.

For example, in accordance with this invention, any inequality in the surface of the pipe ledge, between the portion resing upon support plate 132 and the portion of the pipe resting upon support plate 133, which might unbalance the load in favor of either one or the other plate, would result in an unbalancing of the weight upon traverse beams 122, 123, causing an unbalancing of the primary support beams 120, thus causing the support beams 120 to pivot about the primary gimbal shafts 125. The primary support beams will thereby move in a direction to counteract the unbalancing effect on the plates 132, 133. This results in a vertical balancing of the pipe, avoiding any undesirable net transverse stress; such net stress is translated as a torsional stress on the pipe string, which is especially significant at the interface between the pipe hub and the major length of pipe surface. Alternatively, an unbalancing on one or both of the pipe support plates 132, 133 is counterbalanced, or offset, by a pivoting movement of one or both of the support plates 132, 133, about the gimbal shafts 135, until the plate or plates are maintained in a position whereby the unevenness or unbalance is equalized, and the pipe remains in a balanced vertical condition. As the two gimbal axes, i.e., through the primary support beam shafts 125 and the secondary gimbal shafts 135, act independently of each other, any intermediate unbalancing will be compensated for by movement of both of the two gimbal means, each in an amount to compensate for the unbalance.

The pair of support plates must be capable of being moved radially outwardly apart a sufficient distance not only to clear the pipe hubs, but also to clear any fairing or other obstruction, such as a splitter plate, that is connected along the pipe section at locations intermediate the two pipe hubs. As is explained in the concurrently filed Application, these pipes may have connected thereto either one or more splitter plates, extending radially outwardly from the outer circumference of the pipe, or a fairing completely surrounding the pipe, and thus enlarging the effective diameter of the intermediate portion of the pipe, in certain directions equal to or larger than the diameter of the pipe hub ends. FIG. 5 depicts a fairing, in phantom lines, attached to the pipe section.

The extent of the radial inward movement of the support plates is limited by the outer diameter of the pipe hub. As explained above, it is preferred that the inner end of each of the support members not contact the circumference of the pipe. In order to obtain this desirable spacing, stop mechanisms are provided, for limiting the radially inward travel of the traverse beams 122, 123. It is also desirable to provide for positive locking mechanisms to prevent separation of the traverse beams 122, 123, while the support plates are supporting the pipe, in the event of any accidental hydraulic failure of the motor 145. It is expected that the outer diameter of the pipe in a dredge pipeline will vary, generally decreasing from the surface downwardly to the ocean floor, once the entire dredge pipeline is in place. Thus, during tripping, the inward travel of the beams 122, 123 must be varied as different diameter pipes are utilized. This can be readily accomplished by replaceable stop means which are well known in the art, the specific design of which does not form a part of this invention. An example of such stop means include the placing of a pin or other obstruction through or around the traverse screws 143, to prevent movement theralong of the beams 122, 123.

The hydraulic motor 145, and traverse screws 143, is not the sole means by which the traverse beams can be moved. Any type of system providing reciprocal movement can be used, including for example, direct connection of each beam to an hydraulic piston rod, or electrical systems, e.g., electric motors.

The examples given herein include a load-supporting ledge having a generally circular perimeter. However, any shape perimeter can be handled by this system, including an irregular curvilinear or polyhedral shape, or an internal perimeter, i.e., the supported member surrounds the support members. Further, the system shown herein has two support plates evenly spaced around the perimeter and each support plate is of substantially equal surface area. This is not required, although it does, of course, simplify the calibration of the interconnected load balancing means.

The patentable embodiments of this invention which are claimed are as follows:

1. Support means for supporting a relatively heavy weight having a horizontally extending, downwardly facing surface, the means comprising:

(a) a primary support platform;

(b) a plurality of load support members arranged around a central axis and each having an upwardly facing supporting surface:

(c) balancing and connecting means pivotably connecting the load support members to the primary support platform about two transverse, horizontal axes, each load support member being independently pivotally supported about at least one such horizontal axis; and (d) drive means for reciprocally moving the load support member relative to the central axis, towards and away from a load supporting position;

whereby the weight is substantially proportionately supported by the support surfaces of the plurality of load support members when the load support members are balanced about the transverse axes, such that net transverse stress is minimized on the weight being supported.

2. The support means of claim 1 wherein the balancing and connecting means comprise a primary support member pivotably connected to and supported by the primary platform about the first horizontal axis, and which in turn pivotally supports each of the plurality of load support members about the second horizontal axis.

3. The support means of claim 1 wherein the support members are supported above the primary support platform.

4. The support means of claim 1 wherein the support surfaces in combination form a segmented annular surface about the central axis of the load support members.

5. Support means for supporting an object having a substantially circular cross-section, such as a pipe length having an enlarged hub portion, with a downwardly facing annular surface, from a floating vessel, the support means comprising:

(a) a primary support platform, gimbal means for pivotally connecting the primary support platform to the floating vessel for movement about first and second transverse horizontal axes so as to compensate for any pitching or rolling of the vessel due to turbulence of the water;

(b) a plurality of primary support members, each pivotably connected to the primary support platform about a third horizontal axis;

(c) a plurality of support plate segments each having a generally upwardly facing support surface and designed to be independently pivotably connected to a primary support member about a fourth horizontal axis transverse to the third axis, the segments being arranged and distributed in a suitable manner to surround the circumference of an enlarged pipe hub so as to permit a balanced support of the object by contact of the annular surface of the enlarged portion with the support surfaces; and translational drive means for moving each of the support plate segments radially along the primary support means reciprocally, towards and away from the object to be supported;

such that an excess load against one or more support plate surfaces generates pivoting movement of the support plate segments about one or both third and fourth horizontal axes until the loads on all support plate surfaces are substantially proportionally equal.

6. The support means of claim 5 wherein the plurality of primary support means pivot as a unit about the first horizontal axis.

7. The support means of claim 5, comprising secondary support means horizontally movably connected to the primary support means, the support plate segments being connected to the secondary support means.

8. The support means of claim 7 comprising a plurality of secondary support means, each being connected independently to one of the support plate segments, the secondary support means being connected to the translational drive means.

9. Support means for supporting relatively heavy objects having a horizontally extending, downwardly facing ledge surface perimeter, the support means comprising:

(a) a primary support platform;

(b) a plurality of primary support means pivotably supported from the primary platform about a first horizontal axis;

(c) secondary support means slidably connected to the primary support means;

(d) a plurality of support plate segments each having an upwardly facing support surface and being pivotably connected to the secondary support means about a second, transverse horizontal axis; and (e) translational drive means connected between the primary support means and the secondary support means to move the secondary support means, and thus the support plate segments reciprocally radially inwardly and outwardly, between a supporting position for the heavy object and out of the supporting position.

10. The support means of claim 9 combined with a second support means, the two support means being in-line and relatively vertically movable.

11. The support means of claims 1, or 9, wherein the primary support platform is supported on a floating surface vessel, and further comprising means to pivotally connect the primary support platform to the vessel for movement about two transverse horizontal axes.

* * * * *